US010633148B2

(12) United States Patent
Chaturvedi

(10) Patent No.: US 10,633,148 B2
(45) Date of Patent: Apr. 28, 2020

(54) PEELABLE TAMPER EVIDENT DIAPHRAGM AND PACKAGE MADE THEREOF

(71) Applicant: Ashok Chaturvedi, New Delhi (IN)

(72) Inventor: Ashok Chaturvedi, New Delhi (IN)

( * ) Notice: Subject to any disclaimer, the term of this patent is extended or adjusted under 35 U.S.C. 154(b) by 0 days.

(21) Appl. No.: 15/324,953

(22) PCT Filed: Jul. 10, 2015

(86) PCT No.: PCT/IN2015/000280

§ 371 (c)(1),
(2) Date: Jan. 9, 2017

(87) PCT Pub. No.: WO2016/207902

PCT Pub. Date: Dec. 29, 2016

(65) Prior Publication Data

US 2017/0210511 A1 Jul. 27, 2017

(30) Foreign Application Priority Data

Jul. 10, 2014 (IN) ..... 1925/DEL/2014

(51) Int. Cl.
*B65D 33/25* (2006.01)

(52) U.S. Cl.
CPC ..... *B65D 33/2525* (2013.01); *B65D 33/2591* (2013.01)

(58) Field of Classification Search
CPC ..... B65D 33/2525; B65D 33/2591
See application file for complete search history.

(56) References Cited

U.S. PATENT DOCUMENTS 5,224,779 A * 7/1993 Thompson ..... B65D 33/2533 229/81
5,456,928 A * 10/1995 Hustad ..... B65D 33/1691 206/459.1
5,516,583 A * 5/1996 Zhang ..... C09J 123/08 428/355 EN
5,924,795 A * 7/1999 Thompson ..... B65D 33/2533 383/204

(Continued)

FOREIGN PATENT DOCUMENTS

EP 0541093 A1 5/1993
EP 1375370 A1 1/2004

OTHER PUBLICATIONS

European Patent Office, International Search Report and Written Opinion issued in corresponding Application No. PCT/IN2015/000280, dated Oct. 27, 2015.

*Primary Examiner* — Robert Sandy
*Assistant Examiner* — David M Upchurch
(74) *Attorney, Agent, or Firm* — Birch, Stewart, Kolasch & Birch, LLP

(57) ABSTRACT

A tamper evident diaphragm (110) for a flexible package (300) is provided. The tamper evident diaphragm (110) includes two diaphragm strips (112, 116). Each of the diaphragm strips (112, 116) includes at least an outer layer (140) and an inner layer (136) laminated with each other. The inner layer (136) of each of the diaphragm strips (112, 116) is sealable together to form a non-resealable peelable sealed band (142). The outer layer (140) and the inner layer (136) are configured to be sealed with the flaps (120, 124) of a zipper (108) of the flexible package (300).

17 Claims, 7 Drawing Sheets

(56) References Cited

U.S. PATENT DOCUMENTS

| | | | | |
|---|---|---|---|---|
| 6,257,763 | B1 * | 7/2001 | Stolmeier | B65D 33/2591 383/5 |
| 6,386,760 | B1 * | 5/2002 | Tomic | B65D 33/2591 383/203 |
| 7,506,487 | B2 * | 3/2009 | Eads | B65D 31/10 383/203 |
| 8,007,174 | B2 * | 8/2011 | Yamaguchi | A61J 1/10 383/104 |
| 2002/0094138 | A1 * | 7/2002 | Schneider | B65D 33/2591 383/5 |
| 2003/0002753 | A1 * | 1/2003 | Stolmeier | B32B 7/08 383/64 |
| 2003/0179955 | A1 * | 9/2003 | Rehwinkel | B65D 33/2591 383/5 |
| 2003/0198407 | A1 * | 10/2003 | Rehwinkel | B65D 33/2508 383/61.2 |
| 2004/0047524 | A1 * | 3/2004 | Stolmeier | B65B 9/20 383/210 |
| 2004/0161167 | A1 * | 8/2004 | Ausnit | B65D 33/2591 383/5 |
| 2004/0179753 | A1 * | 9/2004 | Schneider | B65D 33/2591 383/5 |
| 2005/0063617 | A1 * | 3/2005 | Tilman | B65D 33/2591 383/5 |
| 2006/0072854 | A1 * | 4/2006 | Schreiter | B65D 33/2591 383/5 |
| 2006/0228055 | A1 * | 10/2006 | Eads | B65D 33/2508 383/61.2 |
| 2006/0291754 | A1 * | 12/2006 | Linton | B65D 33/2591 383/64 |
| 2008/0019619 | A9 | 1/2008 | Eads et al. | |

* cited by examiner

PEELABLE TAMPER EVIDENT DIAPHRAGM AND PACKAGE MADE THEREOF

FIELD OF THE INVENTION

The invention generally relates to flexible packages with a re-closable closure such as a zipper with or without sliders, and more particularly, relates to tamper-evident diaphragm and flexible packages with re-closable closure having such tamper evident diaphragm to prevent counterfeiting.

BACKGROUND OF THE INVENTION

Tamper-evident flexible packages are commonly used in packaging industries to match the demands of consumers. More often, in view of providing tamper-evidence to the re-closable flexible packages, tamper-evident diaphragms are configured to re-closable flexible packages with re-closable means such as zipper with or without slider, in various ways. The tamper-evident diaphragm generally has a scoring which gets torn away from the middle on applying force to access the content inside the re-closable flexible packages.

Nowadays, the application of tamper-evident diaphragm having peel able opening, which offers a smooth feeling to the user while separating away the tamper-evident diaphragm, is gaining popularity. However, the peel able band of polymer is co-extruded on zipper flaps and the tamper-evident diaphragm is sealed over it which makes the manufacturing of each package complicated and costly. The process of co-extrusion is slow and requires specialized expensive machinery and skill.

Therefore, there exists a need for a peel able tamper-evident diaphragm which is cost effective and is easy to manufacture and flexible packages made thereof. Further, the tamper-evident diaphragm and the flexible packages made thereof should ensure user comfort while accessing the content. Also, it is desired that the barrier-properties provided by the tamper-evident diaphragm should be high.

SUMMARY OF THE INVENTION

The present invention describes a tamper evident diaphragm for a flexible package. The tamper evident diaphragm includes two diaphragm strips. Each of the diaphragm strips includes at least an outer layer and an inner layer laminated with each other. The inner layer of each of the diaphragm strips is sealable together to form a non-resealable peelable sealed band. The outer layer and the inner layer are configured to be sealed with flaps of a zipper of the flexible package.

According to another embodiment of the invention a tamper evident structure for a flexible package is disclosed. The tamper evident structure includes a zipper having interlocking elements, and flaps extending downwardly from the interlocking elements. The tamper evident structure further includes a tamper diaphragm sealed to the zipper. The tamper evident diaphragm includes two diaphragm strips having at least an outer layer and an inner layer laminated with each other. The inner layer of each of the diaphragm strips is sealable together to form a non-resealable peelable sealed band. The outer layer and the inner layer are configured to be sealed with the flaps of the zipper.

According to a further embodiment a flexible package including a tamper evident structure is provided. The tamper evident structure includes a zipper, and a tamper evident diaphragm secured to the zipper. The flexible package further includes a bag secured to the tamper evident structure.

BRIEF DESCRIPTION OF THE DRAWINGS

The advantages and features of the invention shall be better understood with reference to the following description taken in conjunction with the accompanying drawing, wherein like elements are identified with like symbols and in which.

Like reference numerals refer to like parts throughout the description of several views of the drawings.

DETAILED DESCRIPTION OF THE INVENTION

Figure 1A:
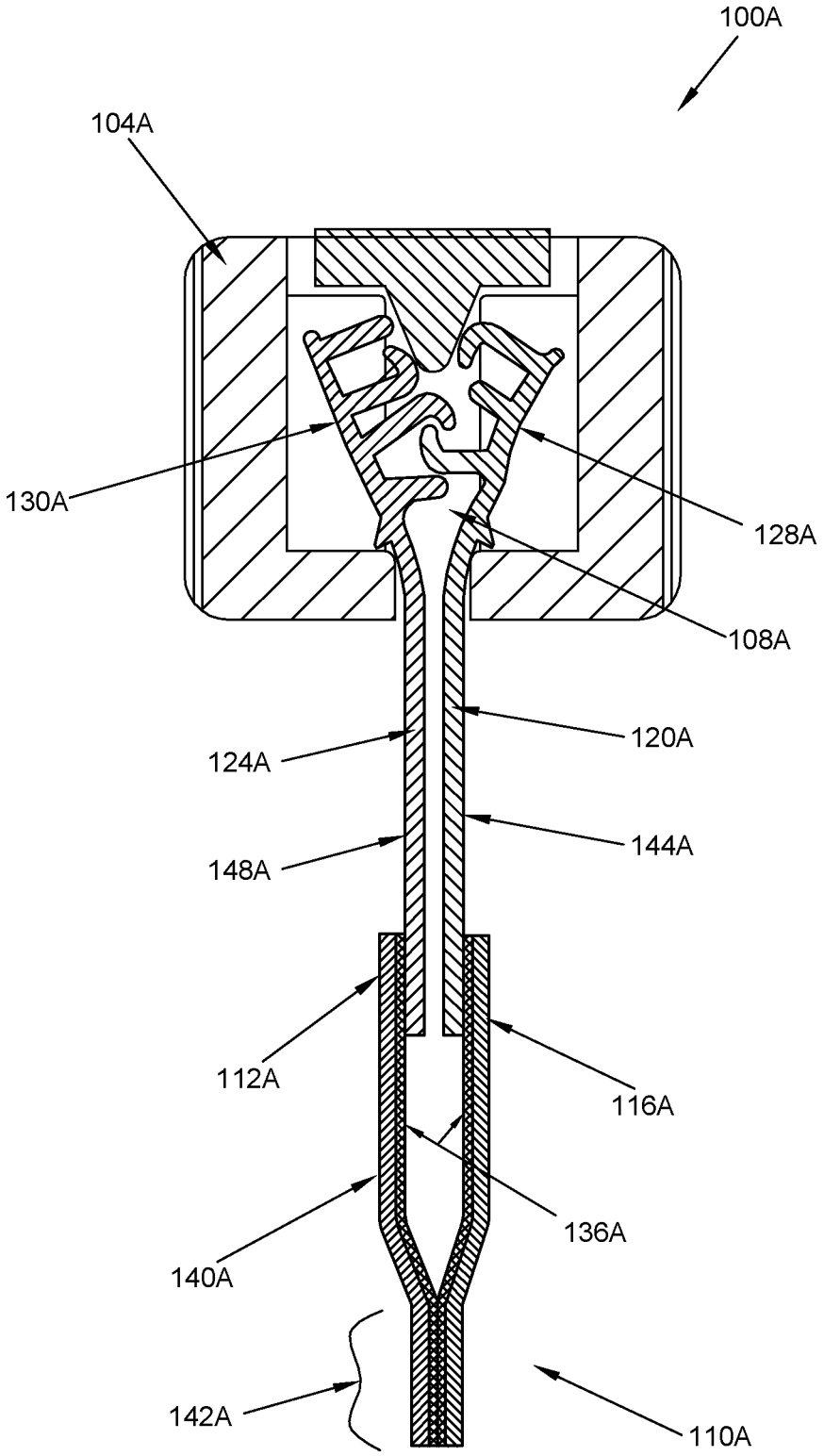
FIGS. 1A-1E illustrate cross sectional views of various arrangements of a slider-zipper with a tamper-evident diaphragm sealed with the flaps of the zipper, in accordance with an embodiment of the invention.

For a thorough understanding of the invention, reference is to be made to the following detailed description in connection with the above-mentioned drawings. Although the invention is described in connection with invention, the invention is not intended to be limited to the specific forms set forth herein. It is understood that various omissions and substitutions of equivalents are contemplated as circumstances may suggest or render expedient, but these are intended to cover the application or implementation without departing from the spirit or scope of the invention. Further, it will nevertheless be understood that no limitation in the scope of the invention is thereby intended, such alterations and further modifications in the figures and such further applications of the principles of the invention as illustrated therein being contemplated as would normally occur to one skilled in the art to which the invention relates. Also, it is to be understood that the phraseology and terminology used herein is for the purpose of description and should not be regarded as limiting. Further, reference herein to "one embodiment" or "an embodiment" means that a particular feature, characteristic, or function described in connection with the embodiment is included in at least one embodiment of the invention. Furthermore, the appearances of such phrase at various places herein are not necessarily all referring to the same embodiment. The terms "a" and "an" herein do not denote a limitation of quantity, but rather denote the presence of at least one of the referenced item.

The invention provides a tamper-evident diaphragm (110) sealed to flaps (120, 124) of a zipper (108) for flexible packages formed from two diaphragm strips (112, 116). Each of the diaphragm strips (112, 116) comprises an outer layer (140) and an inner layer (136). The inner layer (136) and the outer layer (140) of the diaphragm strips (112, 116) are configured to be sealed to the flaps (120, 124) of the zipper (108). The inner layer (136) is made of non-resealable peelable material and the inner layers (136) of both the diaphragms strips (112, 116) are heat-sealed to form a band (142), which can be peeled apart. The strips (112, 116) once peeled apart at the band (142) cannot be resealed thereat or if attempted will not provide peel able seal. In some cases, the outer layer (140) and the inner layer (136) may include one or more layer(s) between them.

FIG. 1A illustrates a tamper evident structure (100A) according to an embodiment of the present disclosure. FIG. 1A further illustrates a zipper (108A) having a slider (104A), with a tamper evident diaphragm (110A) comprising two diaphragm strips (112A) & (116A) sealed on flaps (124A and 120A). The zipper (108A) includes interlocking elements i.e. a male element (128A) and a female element (130A), both being configured to interlock for proper closing when slider (104A) is passed over them in a locking direction.

Each of the diaphragm strips (112A and 116A) comprises an inner layer (136A) and an outer layer (140A) laminated to each other. The inner layer (136A) of each of the diaphragm strips (112A and 116A) is configured to seal with an outer surface (148A and 144A) of each of the flaps (124A and 120A) at one end. The inner layer (136A) of each of the diaphragm strips (112A and 116A) is sealed to form a non-resealable peelable sealed band (142A) at another end, i.e., the band (142A) once peeled-off by any end-user cannot be normally resealed again by mere pressing together the strips (112A and 116A). This imparts tamper-evident feature to the flexible package (300).

It may be apparent to a person skilled in the art that the invention has been explained herein with reference to slider zippers but other reclosable closures such as press-to-lock zippers may also be used.

Such zipper closure assembly with tamper evident diaphragm (110) is suitable for use with film/laminate bags where inner surfaces of the bags end are sealed with the outer surfaces (144A and 148A) of the flaps (120A and 124A) of the zipper (108A) above the diaphragm strips (116A and 112A). A separator of metal or any other suitable un-sealable material may be required to be put between the unsealed inner surfaces (136A) of the diaphragm strips (112A and 116A) during bag making process to prevent sealing of the inner layers (136A) of the diaphragm strips (112A and 116A).

Figure 1B:
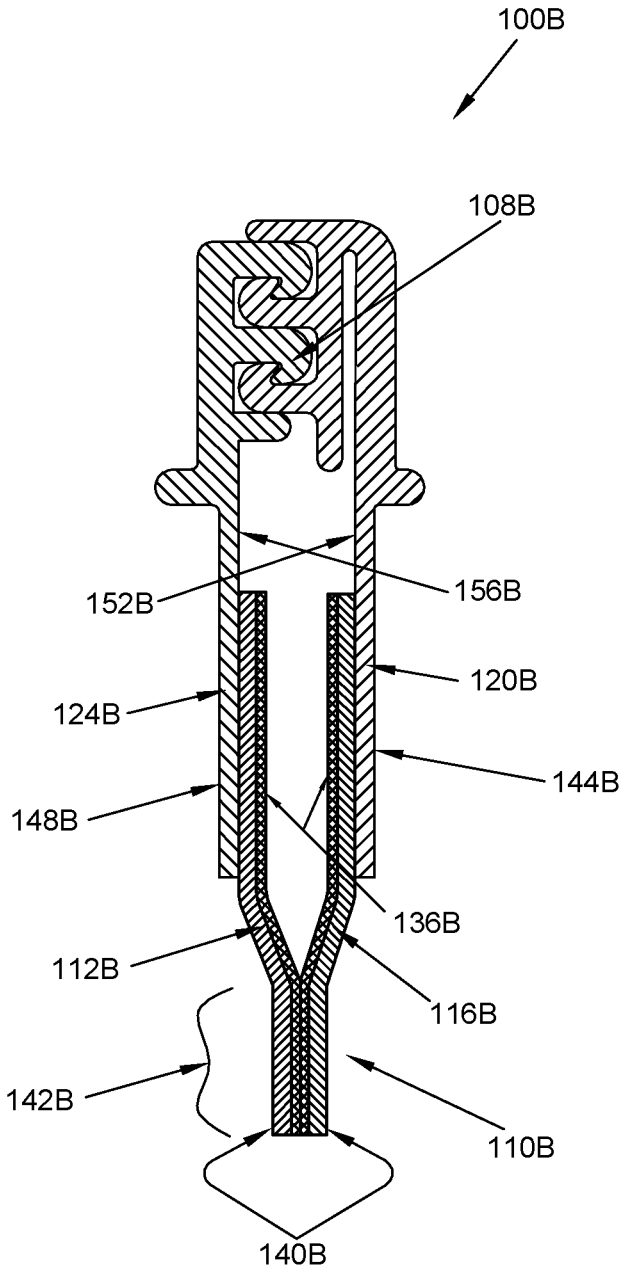

FIG. 1B shows a tamper evident structure (100B) a tamper evident diaphragm (110B) made from diaphragm strips (112B and 116B) sealed to flaps (124B and 120B) of a zipper (108B) such that outer layer (140B) is sealed to inner surfaces (152B and 156B) of the flaps (120B and 124B) and the inner layer (136B) of each of the diaphragm strips (112B and 116B) is sealed together for certain length to provide a non-resealable peelable sealed band (142B).

Such embodiment is generally suitable for film/laminate bags where inner surface of open end of bag are sealed to the outer surface (144B and 148B) of the flaps (120B and 124B). A separator of metal or any other suitable un-sealable material is required to be put between the unsealed inner surfaces (136B) of the diaphragm strips (112B and 116B) during bag making process to prevent sealing of the inner layers (136B) of the diaphragm strips (112B and 116B).

Figure 1C:
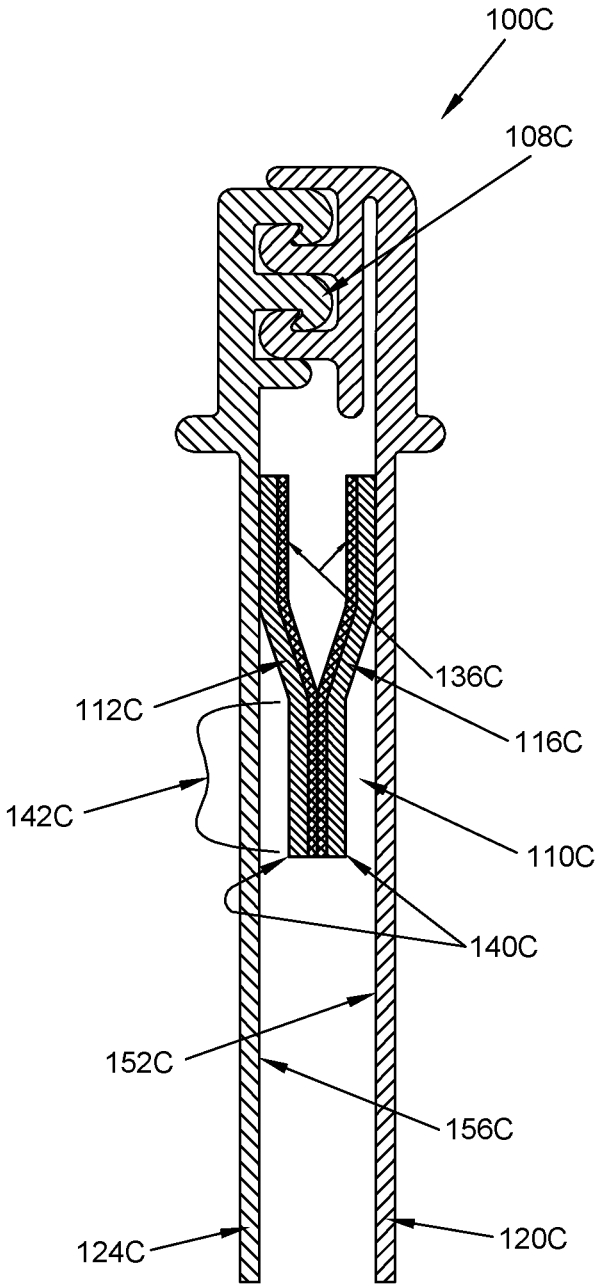

FIG. 1C illustrates a tamper evident structure (100C) which is similar to that in FIG. 1B but for an application where zipper (108C) is required to be sealed to the open-ends of the bag from outside using hot air sealing or hot-melt adhesive sealing or other suitable methods. Hence, the flaps (120C and 124C) of the zipper (108C) are made longer and the tamper-evident diaphragm (110C) smaller in length such that sufficient length of the flaps (120C and 124C) are available for configuring over the open-end of the bag from outside.

Figure 1D:
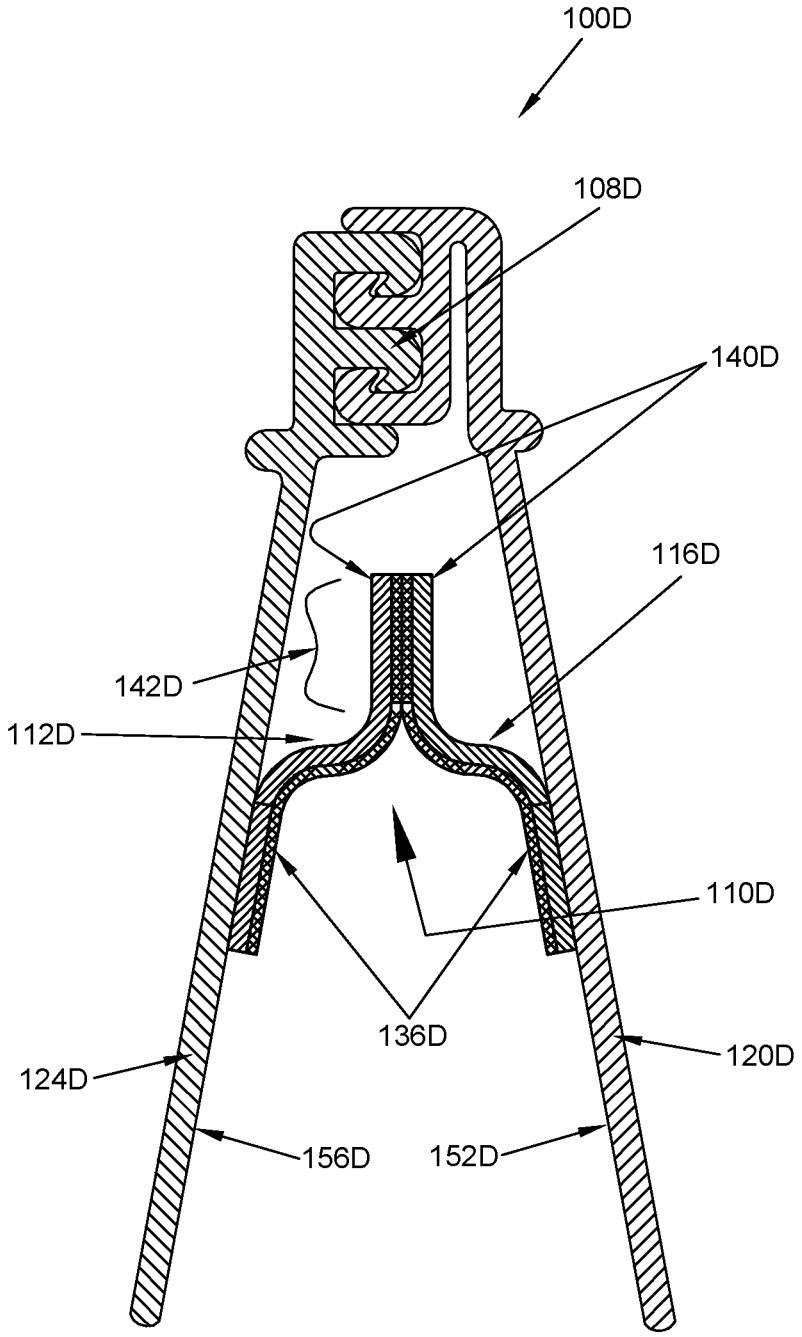

FIG. 1D shows tamper evident structure (100D) outer layers (140D) of the diaphragm strips (112D and 116D) sealed to inner surfaces (156D and 152D) of the flaps (124D and 120D). Inner layers (136D) of the diaphragm strips (112D and 116D) are sealed together to provide a non-resealable peelable sealed band (142D). The diaphragm (110D) is sealed to inner surfaces (156D and 152D) of the flaps (124D and 120D) in an inverted orientation.

Figure 1E:
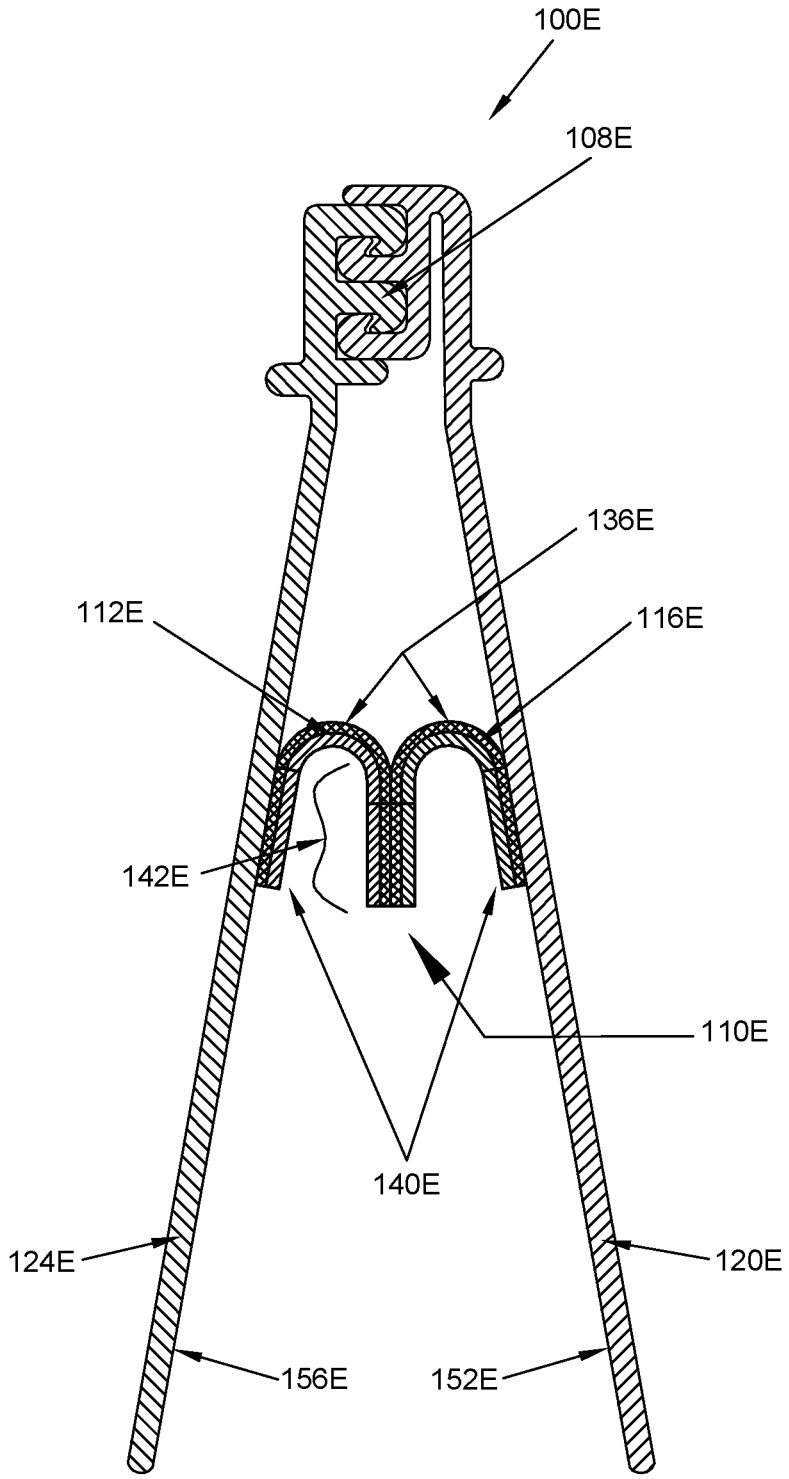

FIG. 1E shows tamper evident structure (100E) including diaphragm strips (112E and 116E) sealed to flaps (124E and 120E) of the zipper (108E) such that inner layers (136E) of the strips (112E and 116E) are sealed to the inner surfaces (156E and 152E) of the flaps (124E and 120E) at one end. The inner surfaces (136E) are sealed again at another end of the diaphragm strips (112E and 116E) to provide a non-resealable peelable sealed band (142E).

In context of the present disclosure, the tamper evident diaphragm (110) may include straight orientation (110A, 110B, and 110C as shown in FIGS. 1A, 1B, and 1C respectively) or an inverted orientation (110 D, and 110E as shown in FIG. 1D, and FIG. 1E respectively).

Different layer structures of diaphragm strips (112A-E and 116A-E) are shown in FIGS. 2A-2D.

Figure 2A:
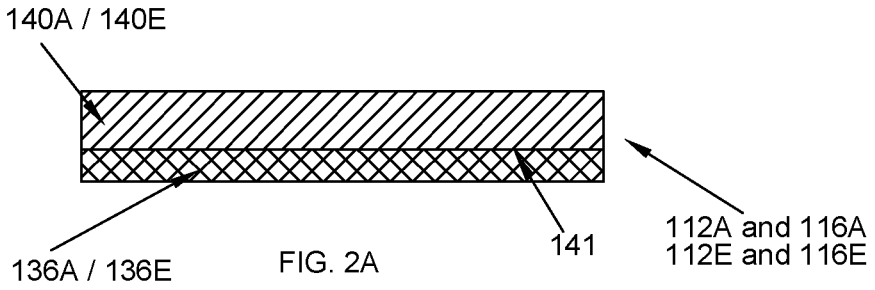
FIGS. 2A-2D illustrates cross-sectional views of some of the substrates of the tamper evident diaphragm, in accordance with an embodiment of the invention.

As shown in FIG. 2A, the outer layer (140A/140E) of the diaphragm strips (112A and 116A, and 112E and 116E) is made up of metalized or non-metalized Biaxially Oriented Polypropylene (BOPP)/Polyethylene Terephthalate (PET)/Oriented Polyamide (Nylon) film. The inner layer (136A/136E) is made up of film of peelable polymer or a blend of peelable polymer with other suitable polymer such as polyethylene or metallocene polyethylene or Polypropylene (PP) or Ethylene-vinyl acetate (EVA). The outer layer (140A/140E) and the inner layer (136A/136E) are laminated using suitable adhesive such as UV curable, E-beam curable, solvent-less adhesive or dry lamination adhesives, water-base adhesive, solvent-base adhesive or any other suitable lamination adhesive, in wide web. This web is subsequently slit into strips of desired width to obtain the diaphragm strips (112A and 112E and 116A and 116E).

The polymers of layers are so selected that the inner layer (136A) of the diaphragm strips (112A and 116A) is sealable to the outer surfaces (144A and 148A) of the flaps (120A and 124A) and the inner layers (136A) are sealed together upto certain length providing the non-resealable peelable band (142A), as shown in FIG. 1A.

In another embodiment, the inner layer (136E) of the diaphragm strips (112E and 116E) can be sealed to the inner surfaces (156 E and 152 E) of the flaps (124E and 120E) and the inner layers (136E) at the other end of the diaphragm strips (112E and 116E) are sealed together upto certain length providing the non-resealable peelable sealed band (142E) in inverted orientation, as shown in FIG. 1E.

An inside surface (141) of outer layer (140A) can be metalized with Aluminum, Aluminum Oxide, Zinc Sulphide, Silicon Oxide, Silver, Gold, Copper, Chrome, Silicon monoxide, Silicon Dioxide, Magnesium Fluoride, Titanium Dioxide, Tin Tungsten Oxide, Indium Tin Oxide or any other suitable metal. The inner layer (136A) is subsequently laminated over the metalized outer layer (140A). The outer layer (140A) can be reverse printed with text, or holographic images, or latent images, or hot or cold stamped portions, or a combination thereof, or provided with holography or may be provided with other anti-counterfeiting features with metallization. It must be appreciated that the inner layer (136A) is transparent if printing or holography or any other feature needs to be visible from open zipper side.

Figure 2B:
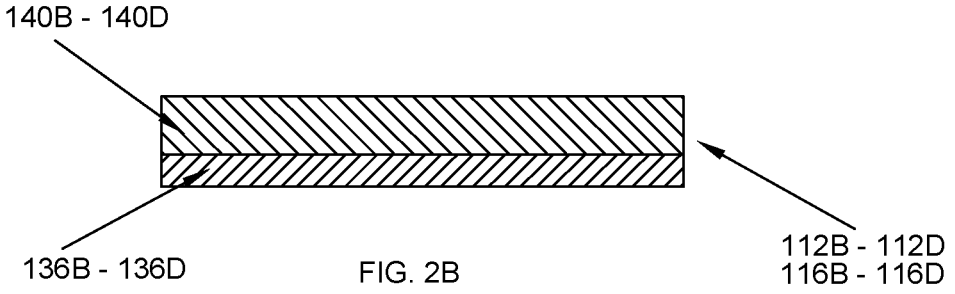

FIG. 2B shows another layer structure of the diaphragm strips (112B-112D and 116B-116D) having two (2) layers, the outer layer (140B-140D) and the inner layer (136B-136D). The outer layer (140B-140D) is made up of polyethylene whereas the inner layer (136B-136D) is made up of sealable Biaxially Oriented Polypropylene (BOPP), or Polyethylene Terephthalate (PET), or Oriented Polyamide (Nylon) film.

The inner layers (136B) of the diaphragm strips (112B and 116B) are sealed to each other up to a certain length providing the non-resealable peelable sealed band (142B) and the outer layer (140B) can be sealed to the inner surfaces (156B and 152B) of the flaps (124B and 120B), as shown in FIG. 1B.

To access the contents inside the flexible packages, one needs to open the zipper (108) by sliding the slider (104) and then pulling apart open ends of the zipper (108) to peel open the tamper-evident diaphragm (110) at the non-resealable sealed band (142).

In another embodiment, the tamper-evident diaphragm (110C) in FIG. 1C is positioned similarly as that shown in FIG. 1B but the flaps (124C and 120C) are made longer to provide sufficient length on inside surfaces (156C and 152C) of the flaps (124C and 120C) for bonding with adhesive or hot melt adhesive or by any other suitable process, from outside over the open end of the bag.

In another embodiment, the tamper evident diaphragm (110D) is sealed with the inner surfaces (152D and 156D) of the flaps (120D and 124D) of a zipper (108D) in the same manner as shown in FIG. 10 but in an inverted orientation, as shown in FIG. 1D.

Figure 2C:
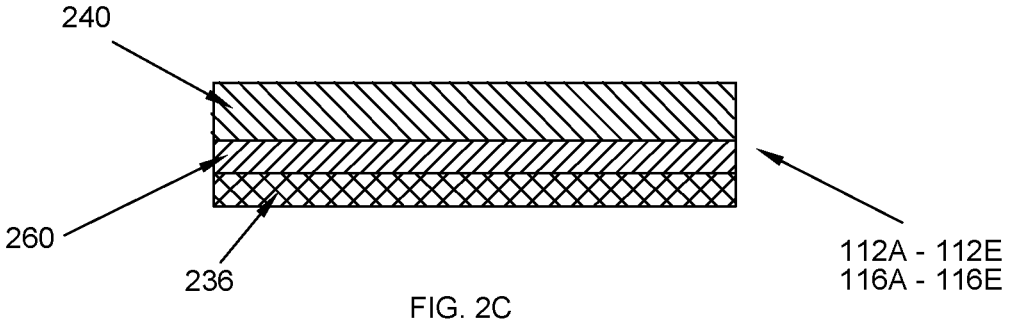

FIG. 2C shows layer structure, according to a different embodiment of the present disclosure, of the diaphragm strips (112A-E and 116A-E) having 3 layers: an outer layer (240), middle layer (260) and an inner layer (236). The outer layer (240) is made up of polyethylene. The inner layer (236) is made up of a film of peelable polymer or a blend of peelable polymer with other suitable polymer such as polyethylene or metallocene polyethylene or Polypropylene (PP) or Ethylene-vinyl acetate (EVA). The middle layer (260) is made up of metalized or non-metalized Biaxially Oriented Polypropylene (BOPP), or Polyethylene Terephthalate (PET), or Oriented Polyamide (Nylon) film.

The polymers of layers are so selected that the inner layer (136A) of the diaphragm strips (112A and 116A) is sealable to the outer surfaces (144A and 148A) of the flaps (120A and 124A) and the inner layers (136A) are sealed together upto certain length providing the non-resealable peelable sealed band (142A), as shown in FIG. 1A.

The inner layers (136B) of the diaphragm strips (112B and 116B) are sealed to each other to certain length providing the non-resealable peelable sealed band (142B) and the outer layer (140B) can be sealed to the inner surfaces (152B and 156B) of the flaps (120B and 124B), as shown in FIG. 1B.

In another embodiment, the tamper-evident diaphragm (110C) is positioned similarly as shown in FIG. 1B but the flaps (124C and 120C) are made longer to provide sufficient length on the inside surfaces (156C and 152C) of the flaps (124C and 120C) for bonding with adhesive or hot melt adhesive or by any other suitable process, from outside over the open end of the bag, as shown in FIG. 1C.

In another embodiment, the tamper evident diaphragm (110D) is sealed with the inner surfaces (152D and 156D) of the flaps (120D and 124D) of the zipper (108D) in the same manner as shown in FIG. 10 but in an inverted orientation, as shown in FIG. 1D.

In another embodiment, the inner layer (136E) of the diaphragm strips (112E and 116E) can be sealed to the inner surfaces (152E and 156E) of the flaps (124E and 120E), and the inner layers (136E) at the other end of the diaphragm strips (112E and 116E) are sealed together up to a certain length providing the non-resealable peelable sealed band (142E) in an inverted orientation, as shown in FIG. 1E.

Figure 2D:
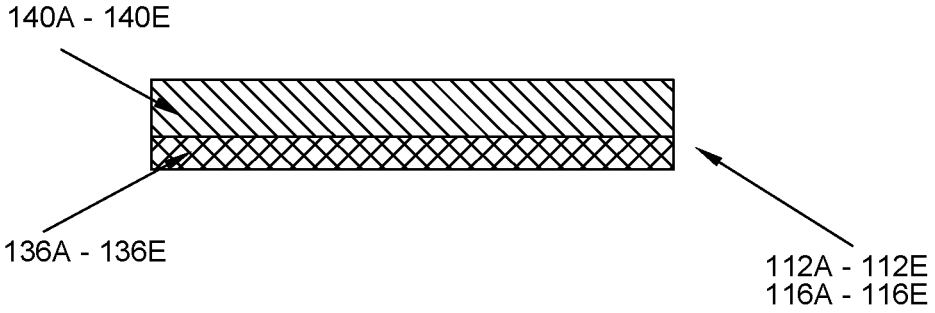

FIG. 2D shows another layer structure applicable to the diaphragm strips (112A-E and 116A-E) having two (2) layers, the outer layer (140A-140E) and an inner layer (136A-136E). The outer layer (140A-140E) is made up of polyethylene wherein the inner layer (136A-136E) is made up of peelable polymer or a blend of peelable polymer with other suitable polymer such as polyethylene or metallocene polyethylene or Polypropylene (PP) or Ethylene-vinyl acetate (EVA). The inside surface of the outer layer (140A-140E) can be metalized with Aluminum, Aluminum Oxide, Zinc Sulphide, Silicon Oxide, Silver, Gold, Copper, Chrome, Silicon monoxide, Silicon Dioxide, Magnesium Fluoride, Titanium Dioxide, Tin Tungsten Oxide, Indium Tin Oxide or any other suitable metal, if barrier properties are to be further enhanced. The inner layer (136A-136E) is subsequently laminated over the metalized outer layer (140A-140E).

To form the non-resealable peelable sealed band (142) between the inner layers and to seal the tamper evident diaphragm (110) with the inner/outer surfaces of the flaps of the zipper (108) heat and pressure sealing is used, however, it is to be appreciated that any other suitable sealing method such as ultrasonic sealing, laser sealing, high frequency sealing, sealing with hot melt adhesive, hot air sealing, sealing using glue, sealing with hot extrusion polymer layer and the like can be used for the purposes.

Figure 3:
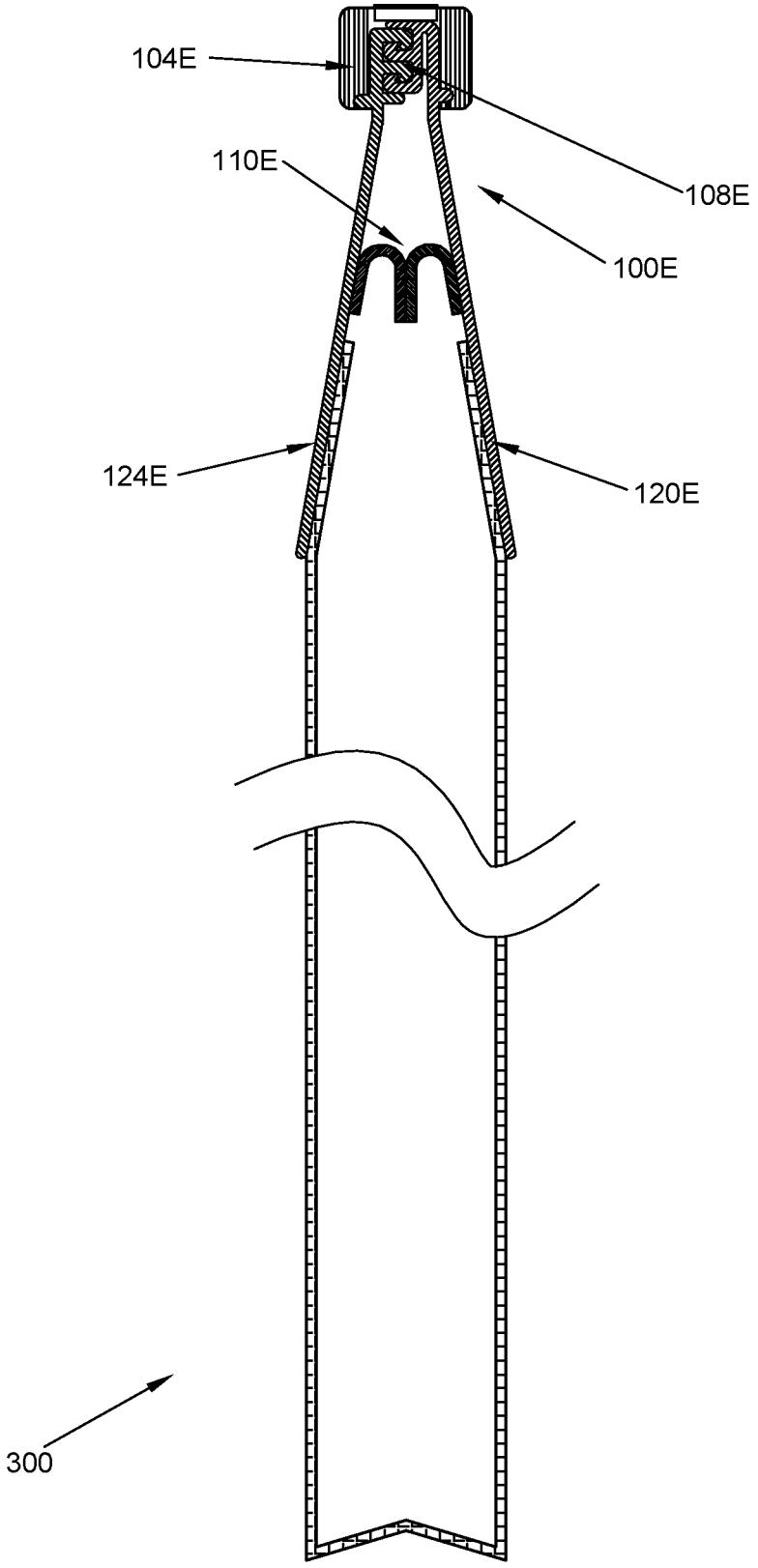
FIG. 3 illustrates cross sectional view of a re-closeable flexible package with one of the embodiments of non-resealable peelable temper evident diaphragm, in accordance with an embodiment of the invention.

FIG. 3 illustrates a flexible package (300) having one of the embodiments of the non-resealable peelable temper evident diaphragm (110E) as shown in FIG. 1E. However it is apparent that other embodiments are also possible in various types of flexible packages as per requirement. The flexible package (300) includes the tamper evident structure (100E). The tamper evident structure (100E) includes the zipper (108E), and the tamper evident diaphragm (110E) secured to the zipper (108E) as explained above. The flexible package (300) further includes a bag (305) secured to the tamper evident structure (100E).

With respect to various embodiments of the present invention, a separator of metal or any other suitable unsealable material may be required to be put between the unsealed inner surfaces (136) of the diaphragm strips (112, 116) during making of the flexible package (300) to prevent sealing of inner surfaces (136) of the diaphragm strips (112, 116).

The invention is advantageous in cost effectively manufacturing the non-resealable peelable tamper-evident diaphragm (110). The tamper-evident diaphragm (110) of the invention does away with the requirement of any costly and time-consuming co-extruding process required for the zipper flaps to introduce peelable material. The tamper-evident diaphragm (110), when pulled apart, opens-up in the middle with a smooth feeling and without any jerk. Metallization in the tamper evident diaphragm (110) of this invention is also enhances the barrier properties of the flexible package (300). Further, with metallization in the tamper-evident diaphragm (110), one can print or provide holograms or additional security features such as latent images etc.

The foregoing descriptions of specific embodiments of the invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the invention.

I claim:

1. A tamper evident diaphragm for a flexible package, the tamper evident diaphragm comprising:

two diaphragm strips, each of the diaphragm strips including at least an outer layer and an inner layer laminated with each other, wherein a portion of the inner layer at a bottom end of each of the diaphragm strips is sealable together;

wherein the portion of the inner layer that is sealable together is configured to form a non-resealable peelable sealed band; wherein (i) the inner layer of the diaphragm strips is sealed to outer surfaces of flaps of a zipper of the flexible package, or (ii) the inner layer of the diaphragm strips is sealed to inner surfaces of the flaps, or (iii) the outer layer of the diaphragm strips is sealed to the inner surfaces of the flaps, provided that the tamper evident diaphragm includes a straight orientation or an inverted orientation; and wherein the sealing is performed using at least one of heat sealing, sealing with hot melt adhesive, hot air sealing, ultrasonic sealing, sealing using glue, sealing with hot extrusion layer, or laser sealing.

2. The tamper evident diaphragm as claimed in claim 1, wherein the outer layer is made up of metalized or non-metalized Biaxially Oriented Polypropylene (BOPP), or Polyethylene Terephthalate (PET), or Oriented Polyamide (Nylon) film, and the inner layer is made up of a film of a peelable polymer, or a blend of peelable polymer with other polymers such as polyethylene, or metallocene polyethylene, or Polypropylene (PP), or Ethylene-vinyl acetate (EVA).

3. The tamper evident diaphragm as claimed in claim 2, wherein inside surface the outer layer may be metalized with at least one of Aluminum, Aluminum Oxide, Zinc Sulphide, Silicon Oxide, Silver, Gold, Copper, Chrome, Silicon monoxide, Silicon Dioxide, Magnesium Fluoride, Titanium Dioxide, Tin Tungsten Oxide, Indium Tin Oxide or a combination thereof.

4. The tamper evident diaphragm as claimed in claim 1, wherein the outer layer may be reverse printed with text, or holographic images, or latent images, or hot or cold stamped portions, or a combination thereof.

5. The tamper evident diaphragm as claimed in claim 1, wherein the outer layer and the inner layer are laminated to each other using an adhesive.

6. The tamper evident diaphragm as claimed in claim 5, wherein the adhesive is one of a UV curable adhesive, E-beam curable adhesive, solvent-less adhesive, dry lamination adhesives, water-base adhesive, solvent-base adhesive.

7. The tamper evident diaphragm as claimed in claim 1, wherein the outer layer is made up of polyethylene and the inner layer is one of a sealable Biaxially Oriented Polypropylene (BOPP), or sealable Polyethylene Terephthalate (PET), or sealable Oriented Polyamide (Nylon) film.

8. The tamper evident diaphragm as claimed in claim 1, wherein the outer layer is made up of polyethylene and the inner layer is made up of a film of peelable polymer, or a blend of peelable polymer with other polymers such as polyethylene, or metallocene polyethylene, or Polypropylene (PP), or Ethylene-vinyl acetate (EVA).

9. The tamper evident diaphragm as claimed in claim 8, wherein the outer layer may be metalized with at least one of Aluminum, Aluminum Oxide, Zinc Sulphide, Silicon Oxide, Silver, Gold, Copper, Chrome, Silicon monoxide, Silicon Dioxide, Magnesium Fluoride, Titanium Dioxide, Tin Tungsten Oxide, Indium Tin Oxide or a combination thereof.

10. The tamper evident diaphragm as claimed in claim 1, further comprising:

a middle layer laminated with at least an outer layer and an inner layer.

11. The tamper evident diaphragm as claimed in claim 10, wherein the outer layer is made up of polyethylene or polypropylene or a combination thereof.

12. The tamper evident diaphragm as claimed in claim 10, wherein the middle layer is made up of a metalized or non-metalized Biaxially Oriented Polypropylene (BOPP), or Polyethylene Terephthalate (PET), or Oriented Polyamide (Nylon) film.

13. The tamper evident diaphragm as claimed in claim 10, wherein the inner layer is a film of peelable polymer or a blend of peelable polymer with other polymers comprising one or more of polyethylene, or metallocene polyethylene, or Polypropylene (PP), or Ethylene-vinyl acetate (EVA).

14. A tamper evident structure for a flexible package, the tamper evident structure comprising:

a zipper including interlocking elements, and flaps extending downwardly from the interlocking elements; and the tamper evident diaphragm as claimed in claim 1.

15. The tamper evident structure as claimed in claim 14, wherein the zipper is with or without a slider.

16. The tamper evident structure as claimed in claim 14, wherein one end of the diaphragm strips is sealed to the flaps, and the other end of the diaphragm strips forms the non-resealable peelable sealed band.

17. A flexible package comprising:

a tamper evident structure including:

a zipper; and the tamper evident diaphragm as claimed in claim 1 secured to the zipper, and a bag secured to the tamper evident structure.

* * * * *